US005779795A

United States Patent [19]

Bucher et al.

[11] Patent Number: 5,779,795

[45] Date of Patent: Jul. 14, 1998

[54] LOW SURFACE ENERGY FLUID METERING AND COATING DEVICE

[75] Inventors: Richard Andrew Bucher; Robert L. Sassa, both of Newark; Tit-Keung Lau, Wilmington, all of Del.

[73] Assignee: W. L. Gore & Associates, Inc., Newark, Del.

[21] Appl. No.: 511,502

[22] Filed: Aug. 4, 1995

[51] Int. Cl.[6] ..... B05C 1/00

[52] U.S. Cl. ..... 118/264; 118/268; 118/DIG. 15; 355/284; 492/56

[58] Field of Search ..... 118/264, 268, 118/DIG. 15, 60; 355/284; 492/56; 219/216

[56] References Cited

U.S. PATENT DOCUMENTS

| | | | |
|---|---|---|---|
| 3,953,566 | 4/1976 | Gore . | |
| 3,962,153 | 6/1976 | Gore . | |
| 4,096,227 | 6/1978 | Gore . | |
| 4,187,390 | 2/1980 | Gore . | |
| 4,530,140 | 7/1985 | Okamura et al. . | |
| 4,796,046 | 1/1989 | Suzuki et al. . | |
| 4,796,049 | 1/1989 | Taniguchi et al. | 355/3 FU |
| 4,819,020 | 4/1989 | Matsushiro et al. | 355/3 FU |
| 5,035,950 | 7/1991 | Del Rosario | 428/421 |
| 5,061,965 | 10/1991 | Ferguson et al. | 355/284 |
| 5,068,692 | 11/1991 | Menjo . | |
| 5,123,151 | 6/1992 | Uehara et al. . | |
| 5,180,899 | 1/1993 | Inasaki . | |
| 5,232,499 | 8/1993 | Kato et al. . | |
| 5,303,014 | 4/1994 | Yu et al. | 355/273 |
| 5,480,938 | 1/1996 | Badesha et al. | 525/104 |
| 5,482,552 | 1/1996 | Kikukawa et al. . | |

FOREIGN PATENT DOCUMENTS

| | | |
|---|---|---|
| 0 616 271 A2 | 9/1994 | European Pat. Off. . |
| 0 619 534 A2 | 10/1994 | European Pat. Off. . |
| 0 654 494 A1 | 5/1995 | European Pat. Off. . |
| 58-17129 | 2/1983 | Japan . |
| 58-20033 | 4/1983 | Japan . |
| 59-168479 | 9/1984 | Japan . |
| 62-178992 | 2/1986 | Japan . |
| 61-148479 | 7/1986 | Japan . |
| 61-183679 | 8/1986 | Japan . |
| 61-240266 | 10/1986 | Japan . |
| 61-243836 | 10/1986 | Japan . |
| 61-245178 | 10/1986 | Japan . |
| 63-172186 | 7/1988 | Japan . |
| 1-031180 | 1/1989 | Japan . |
| 1-205188 | 8/1989 | Japan . |
| 2-308289 | 12/1990 | Japan . |
| 93/06534 | 4/1993 | WIPO . |
| 95/20186 | 7/1995 | WIPO . |

*Primary Examiner*—Long V. Le

*Attorney, Agent, or Firm*—Victor M. Genco, Jr.; Carol A. Lewis White

[57] ABSTRACT

This invention provides a liquid metering and surface coating device which can satisfactorily perform the operation of applying a release liquid to at least the surface of toner image fixation rolls in plain paper copying, with exceptional accuracy, uniformity, and durability. The device comprises a porous support layer adhered to a metal shaft. The porous support layer is comprised of an open-celled thermosetting polymer foam internally reinforced to obtain the strength, resilience, and heat resistance needed for high durability in use as part of a hot toner image fixation mechanism in a PPC machine. The porous support is comprised of materials having high compatibility with and wettability by the liquids to be distributed and having high liquid holding capacity so as to provide smooth continuous liquid delivery. Adhered to the porous support layer is a liquid permeation control layer which is comprised of porous polytetrafluoroethylene film in which the pores contain a mixture of silicone oil and silicone rubber. Adhered to the outer surface of the liquid permeation control layer is a release layer which is comprised of a porous polytetrafluoroethylene film.

12 Claims, 1 Drawing Sheet

LOW SURFACE ENERGY FLUID METERING AND COATING DEVICE

FIELD OF THE INVENTION

The present invention relates generally to materials and devices for coating controlled amounts of liquids on to rolls or other surfaces.

BACKGROUND OF THE INVENTION

In a plain-paper copying (PPC) machine toner images applied to the surface of the paper or other recording medium are fixated by application of heat and pressure. In certain PPC machines, fixation is accomplished by passing the image-bearing recording medium between a hot thermal-fixation roll and a pressure roll. When this type of thermal-fixation device is used, the toner material is directly contacted by a roll surface and a portion of the toner adheres to the roll surface. With subsequent rotation of the roll, the adhered toner material may be redeposited on the recording medium resulting in undesirable offset images, stains, or smears; or, in severe cases, the recording medium may stick to the adhered toner material on the roll and become wrapped around the roll.

To counter these problems, materials having good release properties, such as silicone rubber or polytetrafluoroethylene for example, are often used for the roll surfaces. Use of silicone rubber or polytetrafluoroethylene roll surfaces alone does not eliminate these problems, although such usage has improved performance of the thermal fixation devices.

Another approach used to counter these problems is to include release agents with the toner materials to prevent them from adhering to the roll surface. These oil-less toners also improve performance of the thermal fixation devices, but again, particularly in the case of high-speed type copying machines, do not completely eliminate the problems associated with toner pickup and transfer.

Toner pickup by the rolls can be controlled by coating the surface of at least one of the rolls of a thermal fixation device with a liquid release agent, such as a silicone oil, for example. It is important that such a liquid release agent be applied uniformly and in precise quantities to the surface of the roll. Too little liquid, or non-uniform surface coverage, will not prevent the toner from being picked up and redeposited on the roll. On the other hand, excessive quantities of the liquid release agent may cause silicone rubber roll surfaces to swell and wrinkle, thus producing copies of unacceptable quality. Furthermore, procedures intended to accommodate excess liquids by wiping or scraping them from the roll surface do not always produce favorable results, and, in some cases, such corrective efforts cause excess static electricity that cause further problems.

Devices which claim to uniformly meter and coat a release liquid on copy machine roll surfaces are described in Japanese Laid-Open Patent No. 62-178992. These devices consist of an oil permeation control layer adhered to a thick porous material which serves as a wick or reservoir for supplying oil to the permeation control layer. The permeation control layer is typically a porous polytetrafluoroethylene film which has been impregnated with a mixture of silicone oil and silicone rubber followed by a heat treatment to crosslink the silicone rubber. The thick porous material to which the permeation control layer is adhered is typically porous polytetrafluoroethylene tubing or felts of NOMEX® fibers, glass fibers, carbon fibers, or polytetrafluoroethylene fibers.

The devices described in Japanese Laid-Open Patent No. 62-178992 meter and uniformly coat roll surfaces with release liquids at rates of 0.3 to 1.0 microliters/A4 size paper copy. They have been used successfully in copying machines and provide satisfactory performance during a life span of from about 80,000 to about 180,000 copies. After such time, usually due to deformation and failure of the thick porous material supporting the permeation control layer or to separation of the permeation control layer from the thick porous layer, they can no longer perform acceptably and must be replaced.

This level of performance and durability is not satisfactory for many high-speed automated PPC machines for which release liquid metering and coating devices capable of delivering much smaller liquid quantities for much higher number of copies are needed. Improved devices designed to meet such higher standards are described in U.S. Pat. No. 5,232,499. These devices consist of a liquid permeation control layer adhered to a porous support. The support comprises an open-celled thermosetting polymer foam internally reinforced to obtain the strength, resilience, and heat resistance needed for high durability. The liquid permeation control layer is comprised of a porous polytetrafluoroethylene film, or in a second embodiment, a porous polytetrafluoroethylene film in which the pores are filled with a mixture of silicone oil and silicone rubber. Both embodiments have been used in PPC machines successfully with lives in excess of 500,000 copies. The second embodiment is preferred in that the silicone rubber/silicone oil/porous polytetrafluoroethylene permeation control layer provides a higher level of control in the release of liquids. Conversely, the first embodiment is preferred in that the surface is composed of 100% porous polytetrafluoroethylene, and thus possesses a very low surface energy giving it excellent release qualities. This high level of release prevents accumulation of toner particles on the device, which can cause undesirable image offsetting in successive copies.

The foregoing illustrates limitations known to exist in present fluid metering and coating devices. Thus, it is apparent that it would be advantageous to provide an improved fluid metering and coating device directed to overcoming one or more of the limitations set forth above. Accordingly, a suitable alternative is provided including features more fully disclosed hereinafter.

SUMMARY OF THE INVENTION

This invention provides a liquid metering and surface coating device which can satisfactorily perform the operation of applying a release liquid, for example, to the surface of toner image fixation rolls in plain paper copying, with exceptional accuracy, uniformity, and durability. The device comprises a porous support layer adhered to a metal shaft. The porous support layer is comprised of an open-celled thermosetting polymer foam internally reinforced to obtain the strength, resilience, and heat resistance needed for high durability in use as part of a hot toner image fixation mechanism in a PPC machine. The porous support is comprised of materials having high compatibility with and wettability by the liquids to be distributed and having high liquid holding capacity so as to provide smooth continuous liquid delivery. Adhered to the porous support layer is a liquid permeation control layer which is comprised of porous polytetrafluoroethylene film in which the pores contain a mixture of silicone oil and silicone rubber. Adhered to the outer surface of the liquid permeation control layer is a release layer which is comprised of a porous polytetrafluoroethylene film.

It is a primary purpose of the present invention to provide a low surface energy fluid metering and coating device which combines a silicone rubber/silicone oil/porous polytetrafluoroethylene control layer with a release layer comprised of porous polytetrafluoroethylene to achieve consistent oil release, with minimal toner build up, over an extended part life.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
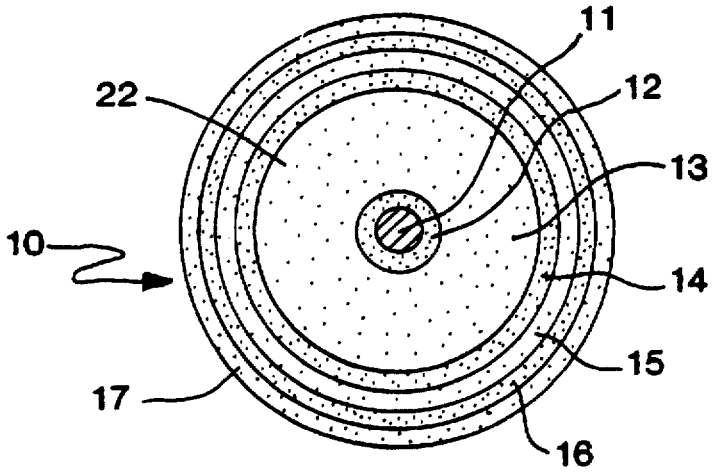
FIG. 1 shows a cross-section of an embodiment of the invention.

Referring now to the drawings, wherein similar reference characters designate corresponding parts throughout the several views, the low surface energy fluid metering and coating device of the present invention is generally illustrated at 10 in the Figures. FIG. 1 shows a preferred embodiment of the present invention which is defined by first axially mounting a tubular porous support material 13 on a metal shaft 11 with an appropriate adhesive. The porous support material 13 should be an open-cell foam or other continuous pore structure having a pore volume of at least 40%, preferably in the range from about 80% to about 99.9%. It should be understood that materials with a pore volume of less than 40% demonstrate an inadequate liquid-holding capacity and may have structures that restrict liquid movement through them. Materials with a pore volume of over 99.9% have such an open, weak structure, that even with internal reinforcement, durability is too difficult to obtain.

The porous support material 13 should also be chemically compatible with, and wettable by, the liquids of use. The porous support material 13 must also have sufficient rigidity, strength, and heat resistance that, when reinforced internally, permits operation at temperatures slightly over 200° C. Preferred materials for the porous support material are thermosetting polymer foams of melamine resin, polyimide resin, phenolic resin, bismaleimide-triazine resin, or polyurethane resin.

A liquid permeation control layer 16 is prepared by adhering a porous material to the surface of the porous support material 13. In this regard, a thermosetting adhesive 15 may be applied to the surface of the porous support material 13 by conventional means, for example, by gravure printing. The preferred material for the permeation control layer 16 is a porous expanded polytetrafluoroethylene (PTFE) membrane film impregnated with a mixture of silicone oil and silicone rubber, as described in Japanese Laid-Open Patent No. 62-178992.

The porous expanded polytetrafluoroethylene membrane may be prepared by any number of known processes, but is preferably prepared by expanding PTFE as described in U.S. Pat. Nos. 4,187,390; 4,110,392; and 3,953,566 (incorporated herein by reference), to obtain porous, expanded, polytetrafluoroethylene. By "porous" it is meant that the membrane has an air permeability of at least 0.01 cubic feet per square foot at 0.5 inch water gauge.

A reinforcing layer 14 is formed internally within the porous support material 13 contiguous to the permeation control layer 16. More particularly, the reinforcing layer 14 is formed by introducing a mixture of silicone oil and silicone rubber into an end of the porous support material 13, and spinning the shaft 11 about its axis. Created centrifugal force directs the mixture of silicone oil and silicone rubber outwardly within the porous support material 13 to form a reinforcing layer 14 of uniform thickness contiguous with an inside surface of the permeation control layer 16. Thereafter, the reinforcing layer 14 is immobilized by cross-linking the silicone rubber.

An oil supply layer 22 is formed internally of the porous support 13 by introducing a second mixture of silicone oil and silicone rubber into the end of the porous support material 13, and spinning the shaft 11 about its axis. Created centrifugal force directs the second mixture of silicone oil and silicone rubber outwardly, within the porous support material, to form a layer contiguous with the reinforcing layer 14, leaving a small section 12 of the porous support material 13 unfilled with the second mixture. Gelation of the second mixture forming the oil supply layer 22 is then effected by crosslinking the silicone rubber.

The properties of silicone oil and silicone rubber in the mixtures of the different layers will vary according to both the amount of permeation required and to the structures and support materials with which they are used. Silicone oil to silicone rubber ratios may range from 50:1 to 1:20 and will be in the relationship:

$$a/x \ll b/x <= c/x$$

where a, b, and c are the oil concentrations in the permeation control layer, reinforcing layer, and oil supply layer respectively.

Discrete reinforcing layers in the porous support are required when the silicone oil to silicone rubber ratio is high, for example 20:1. At such a concentration, oil mobility is high, but virtually no strengthening or toughening of the porous support material is obtained and a separate reinforcing layer must be provided. As the silicone oil to silicone rubber ratio of the oil-supply layer becomes lower, the reinforcing effects of the crosslinked mixtures increase until, at a silicone oil to silicone rubber ratio of about 9:1, sufficient reinforcement to the porous support is obtained such that a separate discrete reinforcing layer is unnecessary. Therefore, at silicone oil to silicone rubber mixture ratios of about 9:1, it is possible to combine reinforcing and oil-supply functions into one layer.

A low surface energy outer layer 17 is prepared by adhering a porous material to the outer surface of the liquid permeation control layer 16 using an adhesive. The preferred porous material for the low surface energy outer layer is porous polytetrafluoroethylene film, or most preferably, porous expanded polytetrafluoroethylene film. This surface both allows the flow of release agents, and inhibits the collection of contamination on the outer surface of the device. Outer layer 17 may have the following physical properties: a thickness ranging from about 0.25 mils to about 10 mils; a porosity ranging from about 50% to about 98%; and a bubble point ranging from about 1 to about 30 pounds per square inch (psi).

Figure 2:
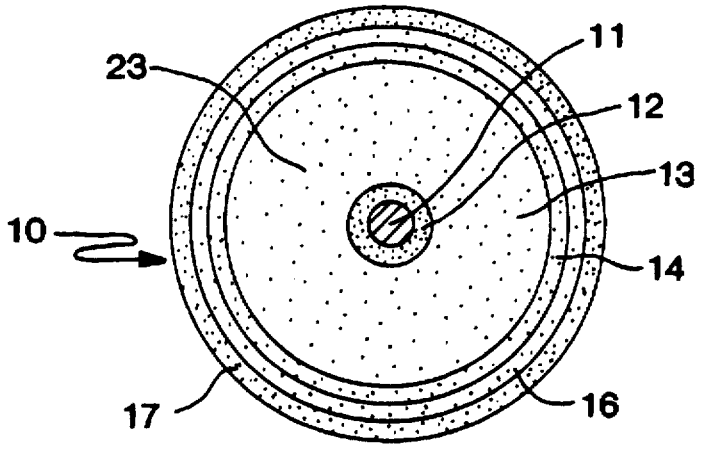
FIG. 2 shows a cross-section of an alternate embodiment of the invention.

FIG. 2 illustrates an alternate embodiment of the present invention which combines reinforcing and oil-supply functions in a combination reinforcing/oil supply layer 23. The embodiment of FIG. 2 does not have a discrete reinforcing layer 14, but otherwise is as described hereinabove.

Figure 3A:
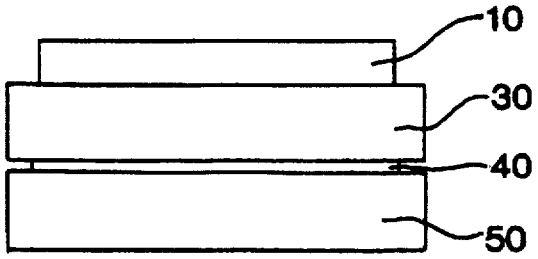
FIGS. 3*a* and 3*b* show front and side schematic views of a toner fixation mechanism of a PPC machine incorporating an embodiment of the invention.
Figure 3B:
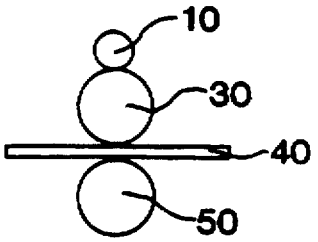

FIG. 3 schematically illustrates the liquid metering and coating device 10 of the present invention as part of a toner image fixation mechanism of a PPC copying machine. The liquid metering and coating device 10 is shown in contact with the thermal fixation roll 30, against which a recording medium 40, such as a sheet of paper, carrying an unstabilized toner image is being forced by the pressure roll 50.

Without intending to limit the scope of the present invention, the apparatus and method of production of the present invention may be better understood by referring to the following examples:

Example 1

A liquid metering and coating device 10, of the type illustrated in FIG. 2, was prepared as follows:

An 8 mm diameter steel shaft 11 was inserted axially into a porous support material 13 of open-celled polyester polyurethane foam. The polyester polyurethane foam support material had an outer diameter of 27 mm, an inner diameter of 8 mm, surface hardness of 28 degrees, bulk density of 230 kg/cubic meter, and a pore volume of 82%.

A porous expanded polytetrafluoroethylene membrane having a thickness of about 30 micrometers, a nominal pore size of 0.5 micrometers, and a pore volume of about 80%, was gravure printed on one side with a non-continuous pattern of 0.5 mm diameter dots of thermoplastic adhesive to form a porous layer of adhesive 14 on the membrane. A permeation control layer 16 was formed by first wrapping a single layer of the adhesive printed membrane around the porous support material 13 and thermally fusing it in place by application of heat and pressure.

A mixture of 20 wt. % silicone oil (KF-96, manufactured by Shin-Etsu Chemical Co., Ltd. and used as a releasing agent) and 80 wt. % silicone rubber (KE-106, manufactured by Shin-Etsu Chemical Co., Ltd.) was prepared. The porous expanded polytetrafluoroethylene film was impregnated with the silicone oil and silicone rubber mixture after which the excess mixture was removed from the film surface and the assembly heated at 150° C. for 40 minutes to crosslink the silicone rubber, thus completing formation of the permeation control layer 16.

A porous expanded polytetrafluoroethylene membrane having a thickness of about 20 micrometers, a nominal pore size of 0.29 micrometers, and a pore volume of about 80%, was coated with a fluoropolymer solution. By way of example only, and not intending to limit the scope of the present invention, a preferred solution for use in coating the membrane is a solution disclosed in PCT Application WO 93/105100 to E.I. duPont de Nemours Company, incorporated herein by reference. A low surface energy outer layer 17 was formed by wrapping a single layer of the coated membrane around the permeation control layer 16 and thermally fusing it in place by application of heat.

A second mixture of the silicone oil and silicone rubber described above, having a silicone oil content of 90 wt. % and silicone rubber content of 10 wt. %, was poured into the end of the porous support body 13, and, by spinning the assembly about its axis, was directed outwardly throughout the porous support body to form an oil-supply reservoir 23, contiguous with the permeation control layer 16. A section 12 of the porous support body 13 was left unfilled by the mixture. The assembly was then heated at 150° C. for 80 minutes to crosslink the silicone rubber and cause gelation in the oil-supply layer 23.

The low surface energy liquid metering and coating device was tested in a plain paper copying machine. The device applied oil at a rate of 0.3 to 0.6 mg/A4 size copy for 60,000 copies where testing was terminated. The roll surfaces showed no signs of toner pick up.

Example 2

A liquid metering and coating device 10, of the type illustrated in FIG. 2, was prepared as per Example 1, except the foam support material 13 comprised melamine foam. This low surface energy liquid metering and coating device was tested in a plain paper copying machine. The device applied oil at a rate of 0.015 to 0.03 mg/A4 size copy for 20,000 copies where testing was terminated. The roll surfaces and copied page showed no signs of toner pick up.

Bubble Point Test

Liquids with surface free energies less than that of stretched porous PTFE can be forced out of the structure with the application of a differential pressure. This clearing will occur from the largest passageways first. A passageway is then created through which bulk air flow can take place. The air flow appears as a steady stream of small bubbles through the liquid layer on top of the sample. The pressure at which the first bulk air flow takes place is called the bubble point and is dependent on the surface tension of the test fluid and the size of the largest opening. The bubble point can be used as a relative measure of the structure of a membrane and is often correlated with some other type of performance criteria, such as filtration efficiency.

The Bubble Point was measured according to the procedures of ASTM F316-86. Isopropyl alcohol was used as the wetting fluid to fill the pores of the test specimen.

The Bubble Point is the pressure of air required to displace the isopropyl alcohol from the largest pores of the test specimen and create the first continuous stream of bubbles detectable by their rise through a layer of isopropyl alcohol covering the porous media. This measurement provides an estimation of maximum pore size.

PORE SIZE AND PORE SIZE DISTRIBUTION

Pore size measurements are made by the Coulter Porometer™, manufactured by Coulter Electronics, Inc., Hialeah, Fla. The Coulter Porometer is an instrument that provides automated measurement of pore size distributions in porous media using the liquid displacement method (described in ASTM Standard E1298-89). The Porometer determines the pore size distribution of a sample by increasing air pressure on the sample and measuring the resulting flow. This distribution is a measure of the degree of uniformity of the membrane (i.e., a narrow distribution means there is little difference between the smallest and largest pore size). The Porometer also calculates the mean flow pore size. By definition, half of the fluid flow through the filter occurs through pores that are above or below this size. It is the mean flow pore size which is most often linked to other filter properties, such as retention of particulates in a liquid stream. The maximum pore size is often linked to the Bubble Point because bulk air flow is first seen through the largest pore.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A liquid metering and coating device comprising:

a porous tubular support comprising a thermosetting polymer comprising open-celled pores;

a porous permeation control material adhered to an outer surface of the porous tubular support;

a reinforcing material contiguous with said permeation control material and located in an outer portion of the pores of said porous tubular support, the reinforcing material comprising a mixture of silicone oil and silicone rubber;

an oil-supply material contiguous with the reinforcing material and substantially filling the pores radially closer to the inner portion of said porous tubular support, the oil-supply material comprising a mixture of silicone oil and silicone rubber; and a low surface energy material which allows the flow of release agents therethrough and inhibits collection of contamination on the device adhesively disposed about an outer surface of the porous permeation control material.

2. The liquid metering and coating device of claim 1, wherein the low surface energy material is porous polytetrafluoroethylene.

3. The liquid metering and coating device of claim 1, wherein the low surface energy material is porous, expanded polytetrafluoroethylene.

4. The liquid metering and coating device of claims 1, wherein the low surface energy material has a thickness ranging from about 0.25 mils to about 10 mils.

5. The liquid metering and coating device of claims 1, wherein the low surface energy material has a porosity ranging from about 50% to about 98%.

6. The liquid metering and coating device of claims 1, wherein the low surface energy material has a bubble point ranging from about 1 to about 30 pounds per square inch.

7. A liquid metering and coating device consisting essentially of:

a porous tubular support comprising a thermosetting polymer comprising open-celled pores;

a porous permeation control material of porous polytetrafluoroethylene adhered to an outer surface of the porous tubular support;

a reinforcing material contiguous with the permeation control material and located in an outer portion of the pores of said porous tubular support, the reinforcing material comprising a mixture of silicone oil and silicone rubber;

an oil-supply material contiguous with the reinforcing material and substantially filling the pores radially closer to the inner portion of said porous tubular support, the oil-supply material comprising a mixture of silicone oil and silicone rubber; and a low surface energy material adhesively disposed about an outer surface of the porous permeation control material;

wherein the low surface energy material permits the flow of oil therethrough from the oil-supply material to an object of interest, and inhibits collection of contamination on the outer surface of the porous permeation control material.

8. The liquid metering and coating device of claim 7, wherein the low surface energy material is porous polytetrafluoroethylene.

9. The liquid metering and coating device of claim 7, wherein the low surface energy material is porous, expanded polytetrafluoroethylene.

10. The liquid metering and coating device of claims 7, wherein the low surface energy material has a thickness ranging from about 0.25 mils to about 10 mils.

11. The liquid metering and coating device of claims 7, wherein the low surface energy material has a porosity ranging from about 50% to about 98%.

12. The liquid metering and coating device of claims 7, wherein the low surface energy material has a bubble point ranging from about 1 to about 30 pounds per square inch.

* * * * *